US009905165B2

(12) United States Patent
Park et al.

(10) Patent No.: US 9,905,165 B2
(45) Date of Patent: Feb. 27, 2018

(54) DISPLAY DEVICE

(71) Applicant: Samsung Display Co., Ltd., Yongin (KR)

(72) Inventors: Kyoung Jin Park, Guri-Si (KR); Min Kyu Woo, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 103 days.

(21) Appl. No.: 14/680,022

(22) Filed: Apr. 6, 2015

(65) Prior Publication Data

US 2016/0163243 A1 Jun. 9, 2016

(30) Foreign Application Priority Data

Dec. 5, 2014 (KR) ..... 10-2014-0173960

(51) Int. Cl.
*G09G 3/3258* (2016.01)

(52) U.S. Cl.
CPC ... *G09G 3/3258* (2013.01); *G09G 2300/0413* (2013.01); *G09G 2300/0809* (2013.01); *G09G 2300/0876* (2013.01); *G09G 2310/0262* (2013.01); *G09G 2320/029* (2013.01); *G09G 2320/0233* (2013.01); *G09G 2320/0238* (2013.01); *G09G 2320/045* (2013.01); *G09G 2330/08* (2013.01)

(58) Field of Classification Search
CPC ... G09G 2300/0413; G09G 2300/0809; G09G 2300/0876; G09G 2310/0262; G09G 2320/0233; G09G 2320/0238; G09G 2320/029; G09G 2320/045; G09G 2330/08; G09G 3/3258
USPC ..... 345/690, 205, 214, 76–78
See application file for complete search history.

(56) References Cited

U.S. PATENT DOCUMENTS 6,979,956 B2 * 12/2005 Park ..... G09G 3/3233 315/169.3
8,092,268 B2 * 1/2012 Yao ..... G09G 3/3233 438/12
2004/0066146 A1 * 4/2004 Park ..... G09G 3/3233 315/169.3

(Continued)

FOREIGN PATENT DOCUMENTS

JP 2013-083679 5/2013
KR 10-2004-0006987 1/2004

(Continued)

*Primary Examiner* — Tony Davis
(74) *Attorney, Agent, or Firm* — H.C. Park & Associates, PLC

(57) ABSTRACT

A display device comprises a display panel including a plurality of active pixels and a plurality of dummy pixels adjacent to the plurality of active pixels and a control unit controlling a pixel driving circuit formed in each of the active pixels and a dummy driving circuit formed in each of the dummy pixels. The dummy driving circuit includes a dummy driving transistor, an A dummy transistor, and a B dummy transistor, and a control terminal of the A dummy transistor is connected to a control terminal of the dummy driving transistor, and an input terminal of the A dummy transistor is connected to an output terminal of the B dummy transistor, and an output terminal of the A dummy transistor is connected to an output terminal of the dummy driving transistor.

20 Claims, 15 Drawing Sheets

(56) References Cited

U.S. PATENT DOCUMENTS

2008/0036386 A1* 2/2008 Shin ..... G09G 3/3225 315/169.3
2013/0148049 A1 6/2013 Abe et al.
2014/0292827 A1* 10/2014 Kang ..... G09G 3/20 345/690
2014/0313106 A1* 10/2014 In ..... G09G 3/3233 345/76
2014/0346475 A1* 11/2014 Cho ..... H01L 27/326 257/40
2015/0103103 A1* 4/2015 Kim ..... G09G 3/3233 345/690
2015/0108437 A1* 4/2015 Cho ..... H01L 27/3248 257/40
2015/0109189 A1* 4/2015 Hwang ..... G09G 3/3225 345/78
2015/0262526 A1* 9/2015 Park ..... G09G 3/3233 345/76
2015/0294618 A1* 10/2015 Park ..... G09G 3/3291 345/214
2015/0348466 A1* 12/2015 Park ..... G09G 3/3233 345/205
2015/0364116 A1* 12/2015 Kong ..... G09G 3/3291 345/205
2015/0364531 A1* 12/2015 Kim ..... H01L 27/3276 257/40
2016/0035283 A1* 2/2016 Park ..... G09G 3/3258 345/214
2016/0104421 A1* 4/2016 Park ..... G09G 3/3233 345/212
2016/0140897 A1* 5/2016 Park ..... G09G 3/3225 345/77
2016/0163243 A1* 6/2016 Park ..... G09G 3/3258 345/205
2016/0218155 A1* 7/2016 Park ..... H01L 27/3223
2016/0335950 A1* 11/2016 Kang ..... G09G 3/2085

FOREIGN PATENT DOCUMENTS

KR 10-2011-0057552 6/2011
KR 10-1391100 4/2014

* cited by examiner

DISPLAY DEVICE

CROSS-REFERENCE TO RELATED APPLICATION

This application claims priority from and the benefit of Korean Patent Application No. 10-2014-0173960, filed on Dec. 5, 2014, which is hereby incorporated by reference for all purposes as if fully set forth herein.

BACKGROUND

Field

Exemplary embodiments relate to a display device, and more particularly to a repairable display device.

Discussion of the Background

A display device is a device that visually displays data signals. The display device may be a liquid crystal display, an electrophoretic display, an organic light emitting display, an inorganic EL (Electro Luminescent) display, a field emission display, a surface-conduction electron-emitter display, a plasma display, or a cathode ray display.

Among them, the organic light emitting display means a display device that displays information, such as an image or text, using light that is generated through combination of holes and electrons, which are respectively provided from an anode electrode and a cathode electrode, in an organic layer that is positioned between the anode electrode and the cathode electrode.

The display device as described above is classified into a passive matrix type and an active matrix type according to a method for driving N×M pixels that are arranged in the form of a matrix. Since the active matrix type display device has low power consumption in comparison to the passive matrix type display device, it is suitable for implementing a large area display, and can achieve high resolution. The active matrix type display device includes a pixel driving circuit that is connected to a liquid crystal capacitor or a light emitting diode.

The pixel driving circuit includes a thin film transistor and a capacitor. In the liquid crystal display or organic light emitting display, defects may be generated in the pixel driving circuit, i.e., the thin film transistor or the capacitor, to cause the occurrence of inferiority, such as bright spot or dark spot.

In order to reduce inferiority due to the pixel driving circuit in which inferiority has occurred, there is a method for repairing a pixel driving circuit in which inferiority occurs through additional configuration of a dummy driving circuit.

The above information disclosed in this Background section is only for enhancement of understanding of the background of the inventive concept, and, therefore, it may contain information that does not form the prior art that is already known in this country to a person of ordinary skill in the art.

SUMMARY

The pixel driving circuit in which inferiority has occurred may be repaired through repair wirings with the dummy driving circuit, but addition of such repair wirings may increase resistance and parasitic capacitance. Accordingly, in the case where the same data voltage is applied to the dummy driving circuit, luminance may be lower than desired. Accordingly, the present invention has been made to solve the above-mentioned problems occurring in the related art, and one subject to be solved by the present invention is to provide a display device which can repair pixel inferiority in the case where the pixel inferiority has occurred due to a defect that is generated in a pixel driving circuit, and can make a desired luminance visually recognized.

Additional aspects will be set forth in the detailed description which follows, and, in part, will be apparent from the disclosure, or may be learned by practice of the inventive concept.

Exemplary embodiments of the invention also provide a display device comprising a display panel including a plurality of active pixels and a plurality of dummy pixels adjacent to the plurality of active pixels, and a control unit controlling a pixel driving circuit formed in each of the active pixels and a dummy driving circuit formed in each of the dummy pixels, wherein the dummy driving circuit includes a dummy driving transistor, A dummy transistor, and B dummy transistor, and a control terminal of the A dummy transistor is connected to a control terminal of the dummy driving transistor, an input terminal of the A dummy transistor is connected to an output terminal of the B dummy transistor, and an output terminal of the A dummy transistor is connected to an output terminal of the dummy driving transistor.

The display device further comprises repair wirings formed to extend in a first direction, wherein the repair wirings are formed to overlap the plurality of active pixels that are aligned in the first direction.

The dummy driving circuit includes a first dummy node outputting a driving current that is generated by the dummy driving transistor and a second dummy node connecting a control terminal of the dummy driving transistor to an input terminal of the B dummy transistor, and the pixel driving circuit including an organic light emitting diode and a first pixel node connected to an anode terminal of the organic light emitting diode.

The dummy driving circuits of the dummy pixels that are formed on both ends of the display panel in the first direction are electrically connected to each other through the repair wirings at the first dummy node of the dummy driving circuit.

The dummy driving circuit further comprises a dummy switching transistor, wherein a control electrode of the dummy switching transistor is connected to a control terminal of the B dummy transistor and a terminal to which an input signal is applied, and an input electrode of the dummy switching transistor is connected to a terminal to which a data voltage is applied.

The pixel driving circuit is electrically connectable to the repair wirings at the first pixel node.

The control unit comprises a comparison unit determining whether each of the pixel driving circuits has inferiority, and a synchronization unit synchronizing an output signal of the dummy driving circuit with a data signal provided to the pixel driving circuit.

The comparison unit controls a connection between the repair wirings and a first pixel node of the pixel driving circuit that is formed in each of the active pixels.

Each of the dummy driving circuits comprises a first pumping transistor and a second pumping transistor connecting a terminal to which an initialization voltage is applied and a first dummy node and a pumping capacitor connected to a third dummy node at which an input terminal of the first pumping transistor and an output terminal of the second pumping transistor are connected to each other and a first power voltage terminal, a control terminal of the first pumping transistor is connected to a terminal to which an input signal is applied, an output terminal of the first pumping transistor is connected to the first dummy node, an input terminal of the first pumping transistor is connected to an output terminal of the second pumping transistor at the third dummy node, a control terminal of the second pumping transistor is connected to a terminal to which an input signal is applied, and an input terminal of the second pumping transistor is connected to a terminal to which an initialization voltage is applied.

The display device further comprising repair wirings formed to extend in a first direction, wherein the repair wirings are formed to overlap the plurality of active pixels aligned in the first direction.

The dummy driving circuit includes a first dummy node outputting a driving current that is generated by the dummy driving transistor, the pixel driving circuit includes an organic light emitting diode and a first pixel node connected to an anode terminal of the organic light emitting diode, the dummy driving circuits of the dummy pixels that are formed on both ends of the display panel in the first direction are electrically connected to each other through the repair wirings at the first dummy node of the dummy driving circuit, and the pixel driving circuit is electrically connectable to the repair wirings at the first pixel node.

Exemplary embodiments of the invention also provide a display device comprising a display panel including a plurality of active pixels and a plurality of dummy pixels adjacent to the plurality of active pixels and a control unit controlling a pixel driving circuit formed in each of the active pixels and a dummy driving circuit formed in each of the dummy pixels, wherein the dummy driving circuit includes a dummy driving transistor, A dummy transistor, and B dummy transistor, a control terminal of the A dummy transistor is connected to a control terminal of the dummy driving transistor, an input terminal of the A dummy transistor is connected to an output terminal of the B dummy transistor, and an output terminal of the A dummy transistor is connected to an output terminal of the dummy driving transistor, and the dummy driving circuit includes a boost diode, and a C dummy transistor applying a voltage of an anode terminal of the boost diode to the control terminal of the dummy driving transistor in response to an input signal.

The display device further comprises repair wirings formed to extend in a first direction, wherein the repair wirings are formed to overlap the plurality of active pixels that are aligned in the first direction.

The dummy driving circuit includes a first dummy node outputting a driving current that is generated by the dummy driving transistor, the pixel driving circuit includes an organic light emitting diode and a first pixel node connected to an anode terminal of the organic light emitting diode, the dummy driving circuits of the dummy pixels that are formed on both ends of the display panel in the first direction are electrically connected to each other through the repair wirings at the first dummy node of the dummy driving circuit, and the pixel driving circuit is electrically connectable to the repair wirings at the first pixel node.

The control unit comprises a comparison unit determining whether each of the pixel driving circuits has inferiority, and a synchronization unit synchronizing an output signal of the dummy driving circuit with a data signal provided to the pixel driving circuit.

The comparison unit controls a connection between the repair wirings and a first pixel node of the pixel driving circuit that is formed in each of the active pixels.

The display device further comprises an initialization line extending in a second direction, wherein an input terminal of the C dummy transistor of the dummy driving circuit adjacent in the second direction is electrically connectable to the initialization line.

Exemplary embodiments of the invention also provide a display device comprising a display panel including a plurality of active pixels and a plurality of dummy pixels adjacent to the plurality of active pixels, and a control unit controlling a pixel driving circuit formed in each of the active pixels and a dummy driving circuit formed in each of the dummy pixels, wherein the dummy driving circuit includes a dummy driving transistor, A dummy transistor, B dummy transistor, C dummy transistor, and a boost transistor, a control terminal of the A dummy transistor is connected to a control terminal of the dummy driving transistor, an input terminal of the A dummy transistor is connected to an output terminal of the B dummy transistor, and an output terminal of the A dummy transistor is connected to an output terminal of the dummy driving transistor, an output terminal of the C dummy transistor is connected to the control terminal of the dummy driving transistor, and an input terminal of the C dummy transistor is connected to an output terminal of the boost transistor, and an input terminal of the boost transistor is connected to a terminal to which an initialization voltage is applied, and a control terminal of the boost transistor is connected to the input terminal of the boost transistor.

The control unit comprises a comparison unit determining whether each of the pixel driving circuits has inferiority, and a synchronization unit synchronizing an output signal of the dummy driving circuit with a data signal provided to the pixel driving circuit.

The display device further comprises repair wirings formed to extend in a first direction, wherein the repair wirings are formed to overlap the plurality of active pixels that are aligned in the first direction.

The detailed items of other embodiments are included in the detailed description and drawings.

According to embodiments of the present invention, at least the following effects can be achieved.

That is, in the organic light emitting display, even if a defect is generated in the pixel driving circuit, the pixel inferiority may not be caused. As a result, the pixel inferiority can be greatly reduced to improve the yield.

Further, in the case where low grayscale data is applied, the phenomenon that the organic light emitting diode of the active pixel emits light somewhat brightly due to the parasitic capacitance in comparison to the corresponding data signal can be prevented.

The effects according to the present invention are not limited to the contents as exemplified above, but more various effects are described in the specification of the present invention.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE EMBODIMENTS

Figure 1:
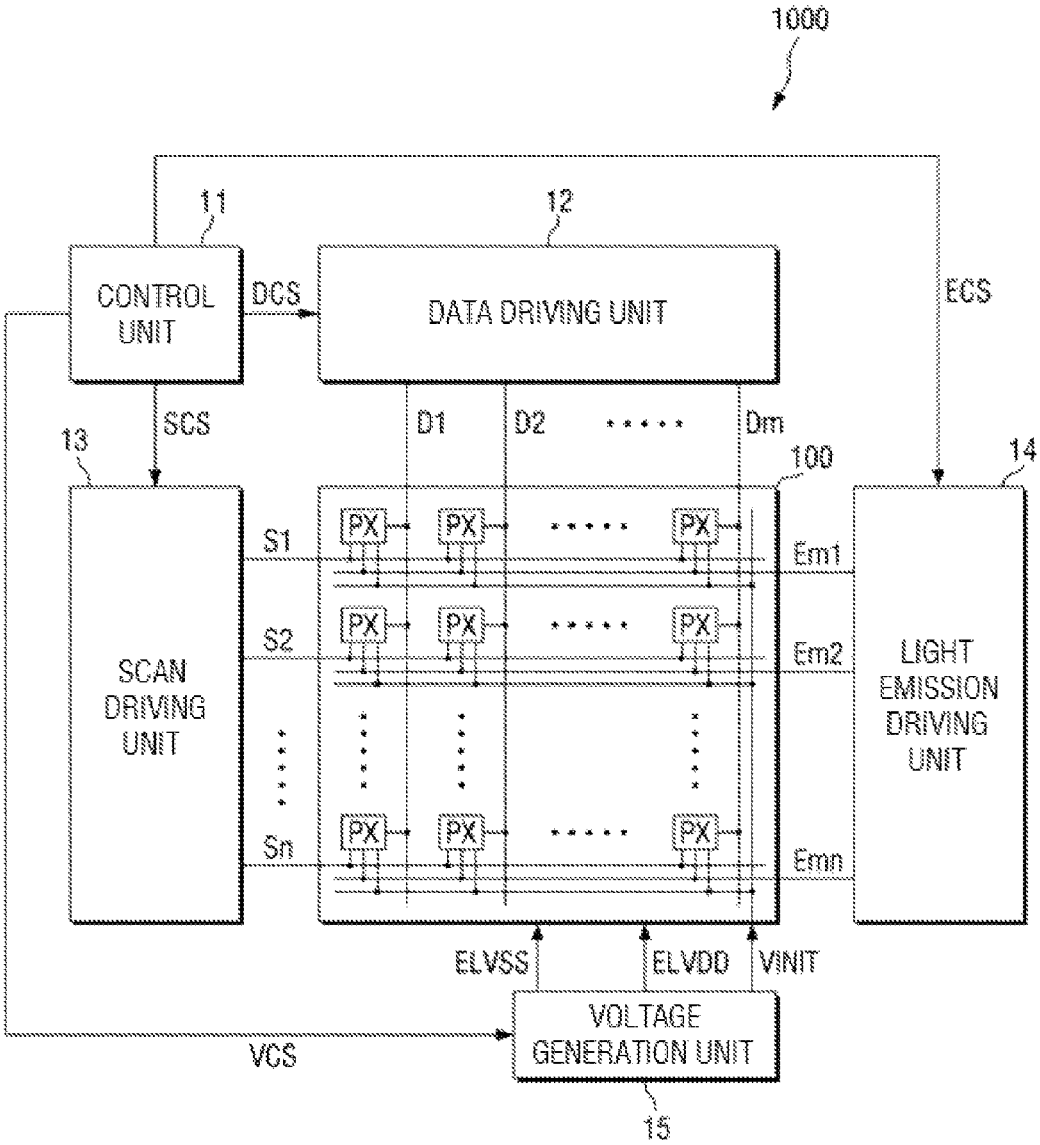
FIG. 1 is a block diagram of a display device according to an embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Hereinafter, preferred embodiments of the present invention will be described in detail with reference to the accompanying drawings.

FIG. 1 is a block diagram of a display device according to an embodiment of the present invention.

Referring to FIG. 1, an organic light emitting display 1000 includes a display panel 100.

The display panel 100 may include a plurality of pixels PX and wirings for transferring signals to the plurality of pixels PX. The plurality of pixels PX may be arranged in the form of a matrix. Each of the plurality of pixels PX may emit light with one color of red, green, and blue. Light emission of the plurality of pixels PX may be controlled by first to n-th scan signals S1 to Sn, first to m-th data signals D1 to Dm, and first to n-th light emission signals Em1 to Emn, which are provided from outside of the display panel 100. The first to n-th scan signals S1 to Sn may control whether the plurality of pixels PX receive the first to m-th data signals D1 to Dm. The first to m-th data signals D1 to Dm may include information on luminance of light emitted from the plurality of pixels PX. The first to m-th light emission signals Em1 to Emn may control whether the plurality of pixels PX emit light.

The wirings may include wirings for transferring the first to n-th scan signals S1 to Sn, the first to m-th data signals D1 to Dm, the first to m-th light emission signals Em1 to Emn, and an initialization voltage VINIT. The wirings for transferring the first to n-th scan signals S1 to Sn and the first to m-th light emission signals Em1 to Emn may be arranged to extend in a row direction of the plurality of pixels PX. The wirings for transferring the first to m-th data signals D1 to Dm may be arranged to extend in a column direction of the plurality of pixels PX. The wirings for transferring the initialization voltage VINIT may be formed in a zigzag form (not shown).

The organic light emitting display 1000 may further include a driving unit and a voltage generation unit 15.

The driving unit may include a control unit 11, a data driving unit 12, a scan driving unit 13, and a light emission driving unit 14. The control unit 11 may receive video data from an outside, and may generate a scan driving unit control signal SCS that can control the scan driving unit 13, a date driving unit control signal DCS that can control the data driving unit 12, and a light emission driving unit control signal ECS that can control the light emission driving unit 14 in response to the received video data.

The driving unit may further include a comparison unit (not shown) determining whether each pixel driving circuit has inferiority, and a synchronization unit (not shown) synchronizing an output signal of a dummy driving circuit with a data signal that is provided to the pixel driving circuit.

The data driving unit 12 may receive the data driving unit control signal DCS, and may generate the first to m-th data signals D1 to Dm in response to the received data driving unit control signal DCS.

The scan driving unit 13 may receive the scan driving unit control signal SCS, and may generate the first to n-th scan signals S1 to Sn in response to the received scan driving unit control signal SCS.

The light emission driving unit 14 may receive the light emission driving unit control signal ECS, and may generate the first to n-th light emission signals Em1 to Emn in response to the received light emission driving unit control signal ECS.

The voltage generation unit 15 may generate the initialization voltage VINIT, a first power voltage ELVDD, and a second power voltage ELVSS to provide such voltages to the display panel 100. In some embodiments, the initialization voltage VINIT, the first power voltage ELVDD, and the second power voltage ELVSS may vary, and the control unit 11 may control the voltage generation unit 15 to change the initialization voltage VINIT, the first power voltage ELVDD, and the second power voltage ELVSS.

Figure 2:
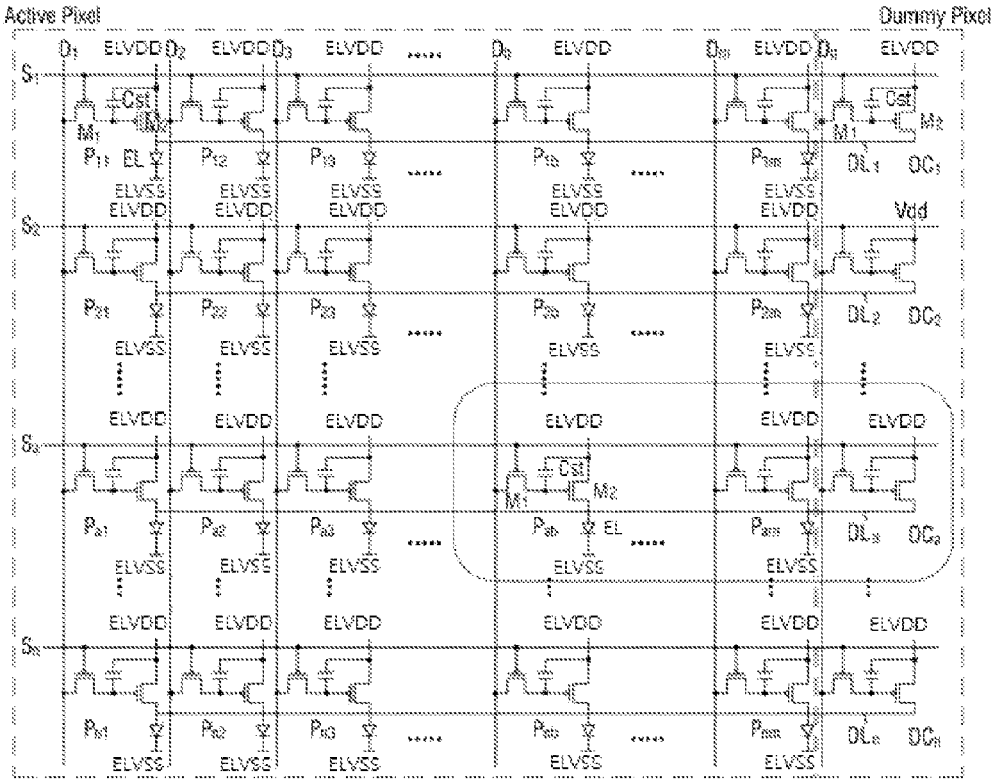
FIG. 2 is a circuit diagram of a pixel array of a display device according to an embodiment of the present invention.

FIG. 2 is a circuit diagram of a pixel array of a display device according to an embodiment of the present invention. Each circuit in the pixels P11 to Pnm and the dummy cells DC1 to DCn disclosed in FIG. 2 is an exemplary embodiment for showing the pixel array and the each circuit will be described in detail with reference to FIGS. 3 through 14.

Referring to FIG. 2, a substrate includes a pixel array area (active area) and a dummy area adjacent to the pixel array area (active area).

Pixels P11 to Pnm may be arranged in the pixel array area (active area), and dummy cells DC1 to DCn may be arranged in the dummy area. Scan lines S1 to Sn may be arranged in one direction in the pixel array area (active area) and the dummy area. Data lines D1 to Dm may be arranged to cross the scan lines S1 to Sn in the pixel array area (active area). As a result, the pixels P11 to Pnm are defined by the scan lines S1 to Sn and the data lines D1 to Dm, which extend to cross each other. Further, a dummy data line Dd may be arranged to cross the scan lines S1 to Sn in the dummy area. As a result, the dummy cells DC1 to DCn may be defined by crossing of the scan lines S1 to Sn and the dummy data line Dd.

Each of the pixels P11 to Pnm may include a pixel electrode and a pixel driving circuit (active pixel) electrically connected to the pixel electrode.

For example, referring to FIG. 2, the pixel driving circuit (active pixel) as disclosed in P11 may include a switching transistor M1, a capacitor Cst, and a driving transistor M2. In this case, the switching transistor M1 may include a gate electrode connected to the scan line S1 and a source electrode connected to the data line D1 and may switch a data signal applied to the data line D1 according to a scan signal applied to the scan line S1. The capacitor Cst may be connected between a drain electrode of the switching transistor M1 and the line to which a first power voltage ELVDD is applied to maintain the data signal for a predetermined period. The driving transistor M2 may include a gate electrode connected to the capacitor Cst, a source electrode connected to the line to which the first power voltage ELVDD is applied, and a drain electrode connected to a light emitting element EL, and may supply current that is in proportion to the size of the data signal to the light emitting element EL, specifically, a pixel electrode of the light emitting element EL. The light emitting element EL may emit light corresponding to the current supplied thereto.

The pixel driving circuit (active pixel) according to an embodiment of the present invention will be described in detail with reference to FIG. 3.

On the other hand, each of the dummy cells DC1 to DCn may include a dummy driving circuit (dummy pixel) for applying an electrical signal to the pixel electrode.

The dummy driving circuit (dummy pixel) may be connected to the scan lines S1 to Sn, the dummy data line Dd, and the terminal of the first power voltage ELVDD.

In an embodiment of the present invention, referring to FIG. 2, like the pixel driving circuit (active pixel), the dummy driving circuit (dummy pixel) as disclosed in DC1 may include a switching transistor M1, a capacitor Cst, and a driving transistor M2. Specifically, the switching transistor M1 includes a gate electrode connected to the scan line S1 and a source electrode connected to the dummy data line Dd, and may switch a data signal applied to the dummy data line Dd according to a scan signal applied to the scan line S1. The capacitor Cst may be connected between the drain electrode of the switching transistor M1 and the terminal of the first power voltage ELVDD to maintain the data signal for a predetermined period. The driving transistor M2 may include a gate electrode connected to the capacitor Cst and a source electrode connected to the line of the first power voltage ELVDD.

Referring to FIG. 2, the dummy lines DL1 to DLn that are electrically connected to the dummy driving circuit (dummy pixel), specifically, the drain electrode of the driving transistor M2, may be arranged in the dummy area. The dummy lines DL1 to DLn may extend toward the pixel array area (active area) and may be arranged on lower portions of the pixel electrodes. The pixel electrodes may overlap the dummy lines DL1 to DLn.

In the process of manufacturing the organic light emitting display as described above, inferiority may occur in the pixel driving circuit (active pixel) that is positioned on a part of the pixels. In this case, the light emitting element EL that is connected to the pixel driving circuit (active pixel) in which the inferiority has occurred may not emit light even in an on-state or may emit light even in an off-state to cause dark spot or bright spot inferiority.

In this case, wirings between the pixel driving circuit (active pixel) of the pixel in which the inferiority has occurred and the light emitting element EL may be disconnected. Referring to FIG. 2, for example, in the case where the defect is generated in the pixel driving circuit (active pixel) of the pixel and the inferiority occurs in the Pab pixel, the wirings between the pixel driving circuit (active pixel) of the Pab pixel, specifically, the driving transistor M2 of the Pab pixel, and the light emitting element EL may be disconnected. However, according to circumstances, the wirings between the pixel driving circuit (active pixel) and the light emitting element EL may not be disconnected, for example, in the case where an electrical signal is not applied to the light emitting element EL due to the defect that is generated in the pixel driving circuit (active pixel). Then, the dummy lines DLa arranged in the lower portion of the pixel electrode of the Pab pixel may be electrically connected. The electrical connection of the dummy lines DLa arranged in the lower portion of the pixel electrode of the Pab pixel may be performed by using a laser repairing method. As a result, the pixel electrode of the Pab pixels may be electrically connected to the dummy driving circuit (dummy pixel) that is positioned in the dummy cell DCa. Thereafter, the Pab pixel is driven by selecting the Sa scan line and applying a data voltage to the data line Dd.

Accordingly, the Pab pixel may not cause the bright spot or dark spot inferiority.

Figure 3:
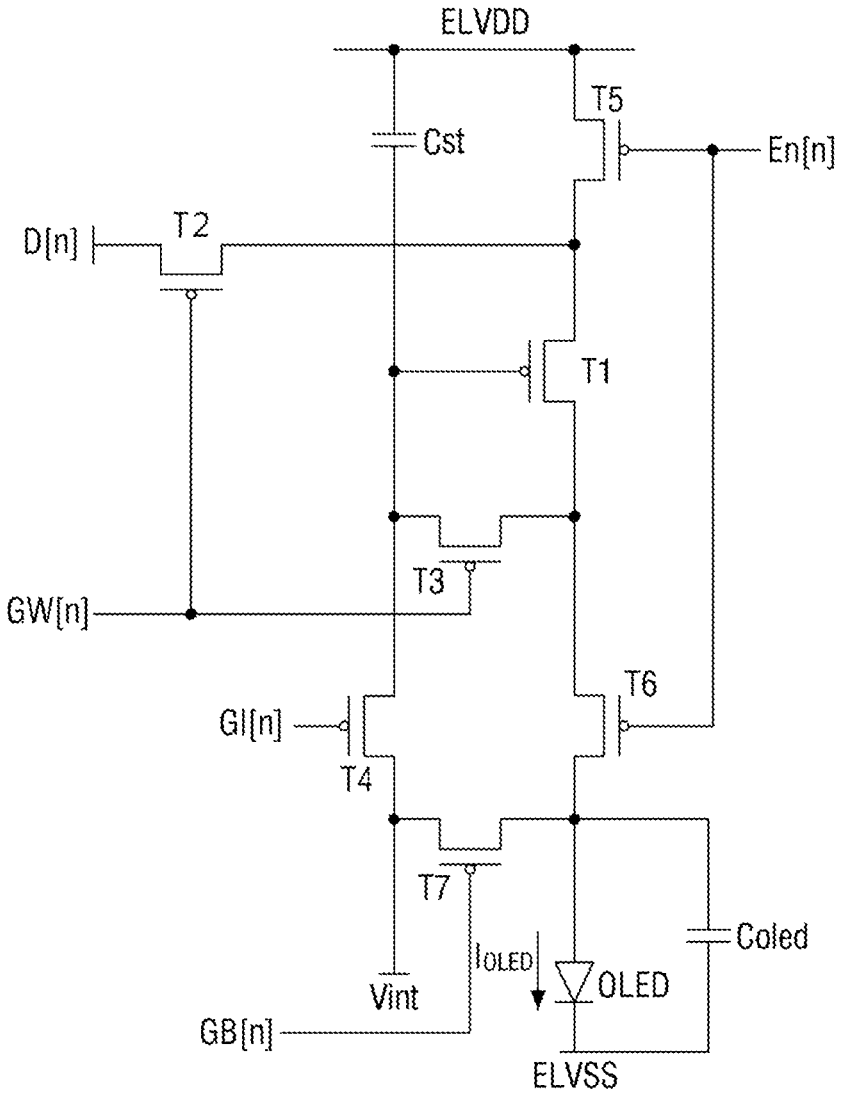
FIG. 3 is an equivalent circuit diagram schematically illustrating one active pixel of a display device according to an embodiment of the present invention.

FIG. 3 is an equivalent circuit diagram schematically illustrating one active pixel of a display device according to an embodiment of the present invention.

Referring to FIG. 3, one active pixel of an organic light emitting display according to an embodiment of the present invention includes a plurality of pixel transistors T1, T2, T3, T4, T5, T6, and T7 to which a plurality of signals may be applied, a storage capacitor Cst, and an organic light emitting diode OLED.

The pixel transistors may include a first pixel transistor T1, a second pixel transistor T2, a third pixel transistor T3, a fourth pixel transistor T4, a fifth pixel transistor T5, a sixth pixel transistor T6, and a seventh pixel transistor T7.

The plurality of signals may include a scan signal GW[n], a previous scan signal GI[n], a light emission control signal En[n], a data signal D[n], a first power voltage ELVDD, a second power voltage ELVSS, an initialization voltage Vint, and a black voltage signal GB[n].

The gate electrode of the first pixel transistor T1 may be connected to one terminal of the storage capacitor Cst, and the source electrode of the first pixel transistor T1 may be connected to the first power voltage ELVDD through the fifth pixel transistor T5. The drain electrode of the first pixel transistor T1 may be electrically connected to the anode of the organic light emitting diode OLED through the sixth pixel transistor T6. The first pixel transistor T1 may receive the data signal D[n] according to the switching operation of the second pixel transistor T2, and may supply driving current IDLED to the organic light emitting diode OLED.

The gate electrode of the second pixel transistor T2 may receive the scan signal GW[n], and the source electrode of the second pixel transistor T2 may receive the data signal D[n]. The drain electrode of the second pixel transistor T2 may be connected to the source electrode of the first pixel transistor T1 and may receive the first power voltage ELVDD through the fifth pixel transistor T5. The second pixel transistor T2 may be turned on according to the scan signal GW[n] to perform switching operation for transferring the data signal D[n] to the source electrode of the first pixel transistor T1.

The gate electrode of the third pixel transistor T3 may receive the scan signal GW[n], and the source electrode of the third pixel transistor T3 may be connected to the drain electrode of the first pixel transistor T1 and may also be connected to the anode of the organic light emitting diode OLED through the sixth pixel transistor T6. The drain electrode of the third pixel transistor T3 may be connected to one terminal of the storage capacitor Cst, the drain electrode of the fourth pixel transistor T4, and the gate electrode of the first pixel transistor T1. The third pixel transistor T3 may be turned on according to the scan signal GW[n], which makes the gate electrode and the drain electrode of the first pixel transistor T1 connected to each other, and thus the first pixel transistor T1 is diode-connected.

The gate electrode of the fourth pixel transistor T4 receives the previous scan signal GI[n], and the source electrode of the fourth pixel transistor T4 receives the initialization voltage Vint. The drain electrode of the fourth pixel transistor T4 is connected to one terminal of the storage capacitor Cst, the drain electrode of the third pixel transistor T3, and the gate electrode of the first pixel transistor T1. The fourth pixel transistor T4 may be turned on according to the previous scan signal GI[n] to transfer the initialization voltage Vint to the gate electrode of the first pixel transistor T1, and thus the voltage of the gate electrode of the first pixel transistor T1 may be initialized.

The gate electrode of the fifth pixel transistor T5 may receive the light emission control signal En[n], and the source electrode of the fifth pixel transistor T5 may receive the first power voltage ELVDD. The drain electrode of the fifth pixel transistor T5 may be connected to the source electrode of the first pixel transistor T1 and the drain electrode of the second pixel transistor T2.

The gate electrode of the sixth pixel transistor T6 may receive the light emission control signal En[n], and the source electrode of the sixth pixel transistor T6 may be connected to the drain electrode of the first pixel transistor T1 and the source electrode of the third pixel transistor T3. The drain electrode of the sixth pixel transistor T6 may be electrically connected to the anode of the organic light emitting diode OLED and the drain electrode of the seventh pixel transistor T7. The fifth pixel transistor T5 and the sixth pixel transistor T6 may be simultaneously turned on according to the light emission control signal En[n], and thus the first power voltage ELVDD is transferred to the organic light emitting diode OLED to make the driving current $I_{OLED}$ flow to the organic light emitting diode OLED.

The gate electrode of the seventh pixel transistor T7 may receive the black voltage signal GB[n], and the source electrode of the seventh pixel transistor T7 may receive the initialization voltage Vint. The drain electrode of the seventh pixel transistor T7 may be connected to the anode of the organic light emitting diode OLED and the drain electrode of the sixth pixel transistor T6. The seventh pixel transistor T7 may be turned on according to the black voltage signal GB[n], and thus the initialization voltage Vint may be transferred to the anode of the organic light emitting diode OLED to apply the black voltage thereto.

The other terminal of the storage capacitor Cst may be connected to the first power voltage ELVDD, and the cathode of the organic light emitting diode OLED may be connected to the second power voltage ELVSS. Accordingly, the organic light emitting diode OLED may receive the driving current IDLED from the first pixel transistor T1 and may emit light to display an image. In this embodiment, it is described that the pixel includes seven transistors and an organic light emitting diode OLED, but is not limited thereto. The pixel included in the organic light emitting display may include a plurality of transistors and organic light emitting diodes OLED.

Figure 4:
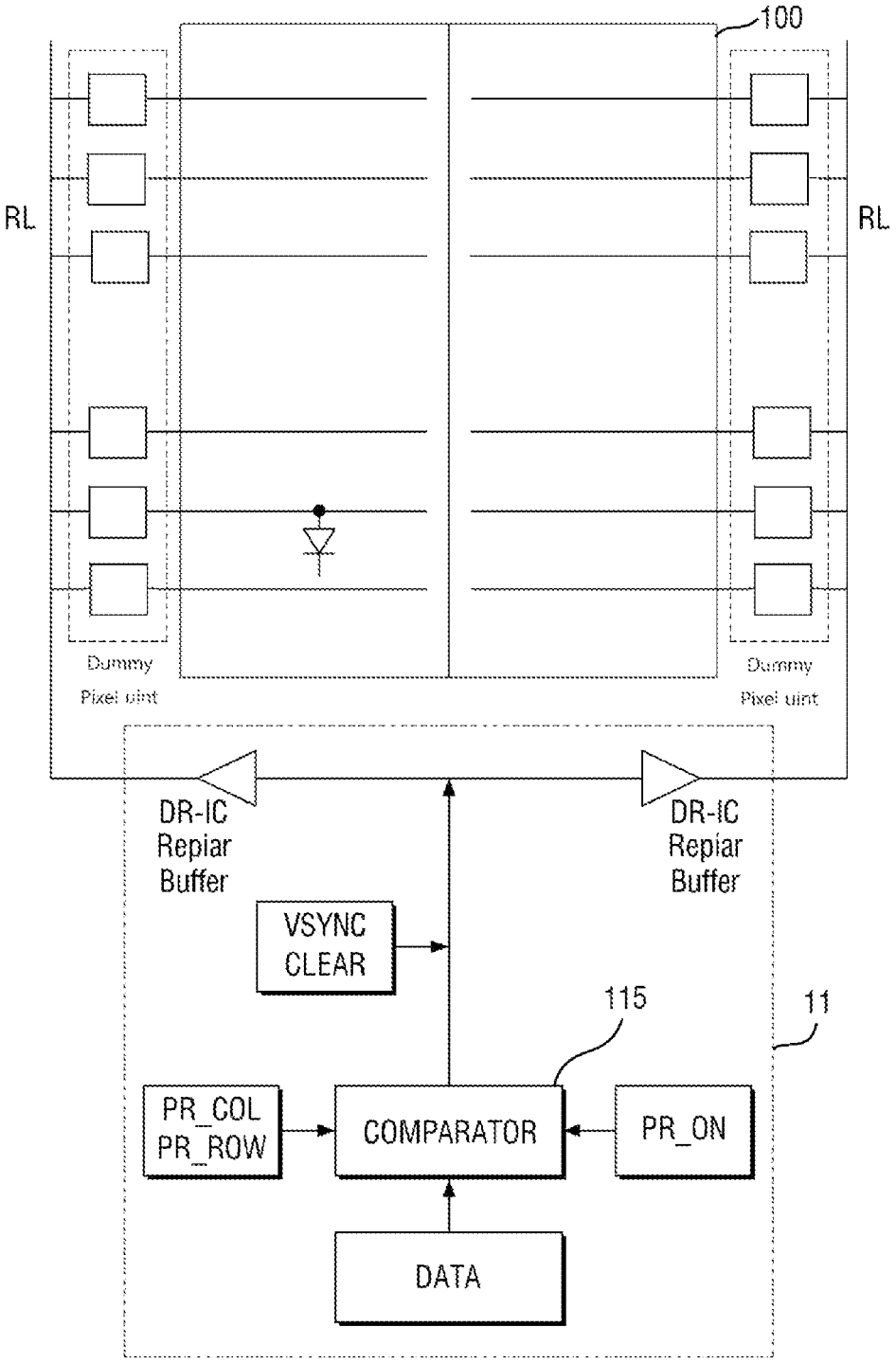
FIG. 4 is a block diagram of a control unit of a display device according to an embodiment of the present invention.

FIG. 4 is a block diagram of a control unit of a display device according to an embodiment of the present invention.

Referring to FIG. 4, a dummy pixel unit may be disposed on both side of the display panel 100. The dummy pixel unit may be connected to the control unit 11 through repair wirings RL. The dummy pixel unit may include a plurality of dummy driving circuits connected to the scan lines. FIG. 4 illustrates that the dummy pixel unit is formed at both terminals of the scan lines, but is not limited thereto. The dummy pixel unit may be formed at both terminals of the data lines, or may be formed at both terminals of the data lines and the scan lines.

The control unit 11 that is connected to the dummy pixel unit may apply DATA to each of the pixel driving circuits (active pixels), and may receive PR_ON that shows whether the pixel driving circuits (active pixels) have inferiority which may be sensed by a sensing element (not illustrated). The sensing element (not illustrated) receives PR_COL and PR_ROW that shows the positon of the pixel driving circuits (active pixels) having inferiority. A comparator 115 of the control unit 11 may determine positions of the individual pixel driving circuits (active pixels) in which the inferiority has occurred and the size of data to be applied to the individual pixel driving circuits (active pixels) and may apply corresponding signals to the repair wirings RL through collection of the PR_ON, the PR_COL and the PR_ROW. The signals that the comparator 115 provides to the repair wirings RL may include a synchronization signal Vsync so that the signals and the data signals from data lines(not shown) can be synchronized with each other to be simultaneously output. The signals that the comparator 115 provides to the repair wirings RL may be provided through a repair buffer (DR-IC repair buffer). The method for sensing the pixel driving circuits in which the inferiority has occurred and the method for applying data to the pixel driving circuit (active pixel) in which the inferiority has occurred are not limited to those as described above.

Figure 5:
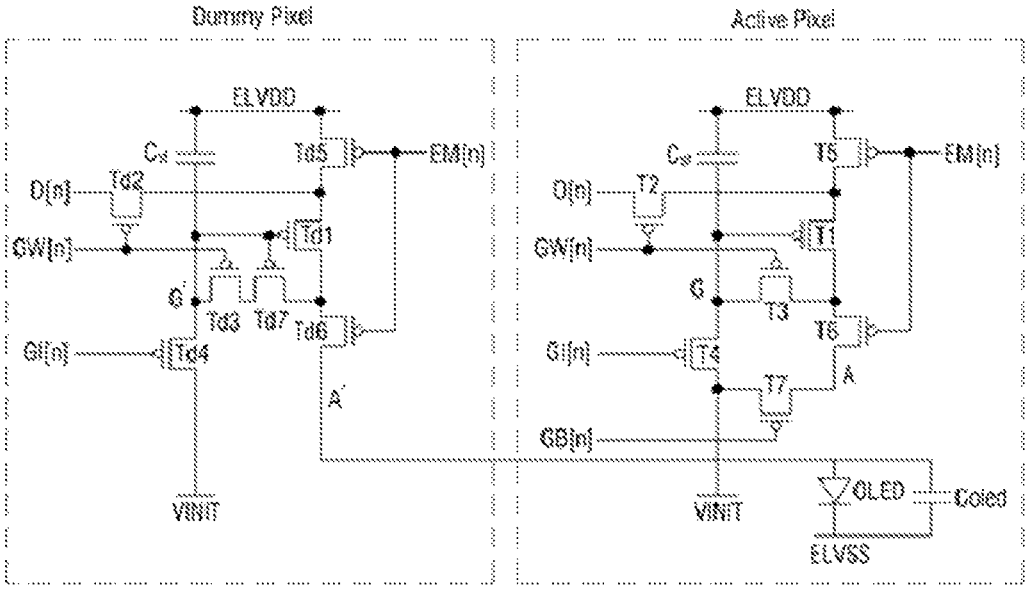
FIG. 5 is an equivalent circuit diagram of one active pixel driving circuit and one dummy pixel driving circuit connected to each other in a display device according to an embodiment of the present invention.

FIG. 5 is an equivalent circuit diagram of one active pixel driving circuit and one dummy driving circuit connected to each other in a display device according to an embodiment of the present invention.

Referring to FIG. 5, the dummy driving circuit (dummy pixel) and the pixel driving circuit (active pixel) may be formed to have the same structure. In the process of manufacturing an organic light emitting display including the dummy driving circuit (dummy pixel) and the pixel driving circuit (active pixel), the inferiority may occur in the pixel driving circuit (active pixel) that is positioned in a part of the pixels. In this case, the wirings between the pixel driving circuit (active pixel) of the pixel in which the inferiority has occurred and the organic light emitting diode OLED may be disconnected. That is, the drain electrodes of the sixth and seventh transistors T6 and T7 of the pixel driving circuit (active pixel) may be open from the anode of the organic light emitting diode OLED at node A (a first pixel node), and the drain electrode of the sixth dummy transistor Td6 of the dummy driving circuit (dummy pixel) may be connected to the anode of the organic light emitting diode OLED at node A' (a first dummy node). However, the wirings between the pixel driving circuit (active pixel) and the light emitting element EL may not be disconnected in the case where any electrical signal is not applied to the organic light emitting diode OLED due to the defect that is generated in the pixel driving circuit (active pixel).

The dummy driving circuit (dummy pixel) and the pixel driving circuit (active pixel) may be connected by the repair wirings, and the repair wirings may be connected to the dummy pixel unit crossing the display panel 100 that may be formed at both ends of the display panel 100. The repair wirings may be composed of a conductive material, but the level of a voltage that is applied to each pixel driving circuit (active pixel) may be decreased due to the resistance of the repair wirings. The dummy driving circuits of the dummy pixels formed at the both ends of the display panel 100 may be disposed in a first direction (row) and be electrically connected through the repair wirings at the first dummy node (node A') of the dummy driving circuit.

The dummy driving circuit (dummy pixel) may include a seventh dummy transistor Td7 (A dummy transistor). The control electrode(gate) of the seventh dummy transistor Td7 may be connected to the control electrode of the first dummy transistor Td1 as a dummy driving transistor, and the output electrode (drain) of the seventh dummy transistor Td7 may be connected to the output electrode of the first dummy transistor Td1. The input electrode (source) of the seventh dummy transistor Td7 may be connected to the output electrode of the third dummy transistor Td3 (B dummy transistor).

The third dummy transistor Td3 is turned on in response to the scan signal GW[n] and connects the output electrode and the control electrode of the first dummy transistor Td1 through the seventh dummy transistor Td7 in turn-on state to each other, and then the first dummy transistor Td1 is diode-connected. Further, the third dummy transistor Td3 connects the control electrode and the output electrode of the seventh dummy transistor Td7 through the first dummy transistor in turn-on state to each other, and thus the seventh dummy transistor Td7 is diode-connected. Consequently, the first dummy transistor Td1 and the seventh dummy transistor Td7 are diode-connected to be forward-biased by the third dummy transistor in turn-on state. Accordingly, a compensation voltage decreased from the data signal D[n] by a threshold voltage Vth of the first dummy transistor Td1 is applied to the gate electrode of the first dummy transistor Td1. The first power voltage ELVDD and the compensation voltage are applied to both terminals of the storage capacitor Cst, and electric charge generated from a voltage difference between the both terminals of the storage capacitor Cst is stored in the storage capacitor Cst. Accordingly, the level of the light emission signal EM[n] is changed from high level to low level, and thus during the light emission period, the fifth and sixth dummy transistors Td5 and Td6 are turned on by the low-level light emission control signal EM[n].

Accordingly, a driving current that corresponds to the voltage difference between the control electrode of the first dummy transistor Td1 and the first power voltage ELVDD is generated, and the driving current through the sixth dummy transistor Td6 is transferred to the pixel driving circuit (active pixel) through node A'. During the light emission period, the voltage Vgs between the control electrode and the output electrode of the first dummy transistor Td1 is maintained constant by the storage capacitor Cst, and the driving current is in proportion to a square of a value that is obtained by subtracting the threshold voltage Vth from the voltage Vgs between the control electrode and the output electrode of the first dummy transistor Td1.

In this case, the seventh dummy transistor Td7 is connected to the first dummy transistor Td1, and it is effective that the channel length of the first dummy transistor Td1 during the compensation period is lengthened twice the channel length of the first pixel transistor T1. That is, unlike the pixel driving circuit in which the level of current that compensates for the voltage Vgs between the gate electrode and the drain electrode of the first dummy transistor Td1 is equal to the level of the light emission current, the channel length of the first dummy transistor Td1 during the compensation period is lengthened twice the channel length of the first dummy transistor Td1 during the light emission period through combination of the first dummy transistor Td1 and the seventh dummy transistor Td7, and thus compensation becomes possible with a lower voltage of the control electrode of the first dummy transistor Td1. Accordingly, it is possible to generate larger current than the current of the pixel driving circuit (active pixel) with respect to the same data voltage, and thus the increase of the resistance due to the repair wirings can be offset.

Figure 6:
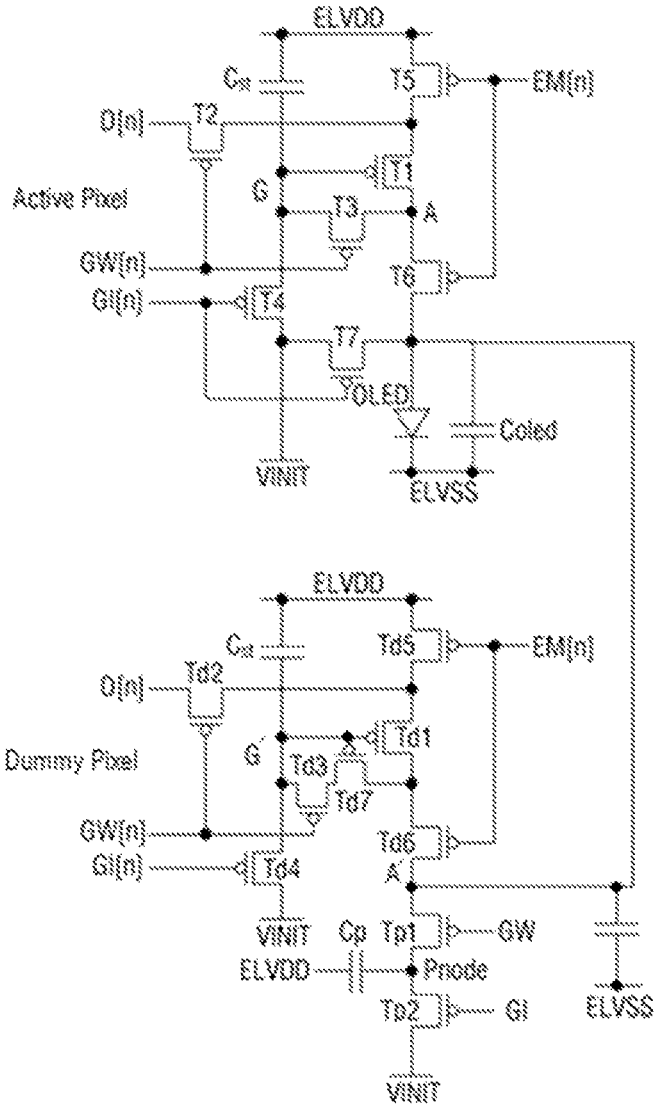
FIG. 6 is an equivalent circuit diagram of one active pixel driving circuit and one dummy pixel driving circuit in a display device according to another embodiment of the present invention.

FIG. 6 is an equivalent circuit diagram of one pixel driving circuit and one dummy driving circuit in a display device according to another embodiment of the present invention.

Since the pixel driving circuit (active pixel) and the dummy driving circuit (Dummy pixel) of FIG. 6 are similar to those illustrated in FIG. 5, explanation will be made around different constituent elements from those illustrated in FIG. 5.

Parasitic capacitance may be formed between node G of the pixel driving circuit (active pixel) and a terminal to which the scan signal GW[n] is applied and between the node G of the pixel driving circuit (active pixel) and the node A. Further, parasitic capacitance may also be formed between node G' (a second dummy node) of the dummy driving circuit (dummy pixel) and the terminal to which the scan signal GW[n] is applied and between the node G' of the dummy driving circuit (dummy pixel) and node A'. Due to such parasitic capacitance, the first thin film transistor T1 of the pixel driving circuit and the first dummy transistor Td1 of the dummy driving circuit (dummy pixel) may be unable to provide an accurate driving current that corresponds to the data signal to the organic light emitting diode OLED.

Referring again to FIG. 6, the gate electrodes of the fourth pixel transistor T4 and the seventh pixel transistor T7 of the pixel driving circuit may be electrically connected to each other, and the fourth pixel transistor T4 and the seventh pixel transistor T7 may be driven by the signal GI[n].

The pixel driving circuit (active pixel) and the dummy driving circuit (dummy pixel) may be connected to each other by the repair wirings, and the repair wirings may be formed to overlap the individual pixel driving circuit (active pixel) and to extend in a row direction (a first direction). If inferiority occurs in the pixel driving circuit (active pixel), the driving current that corresponds to the data signal may be applied to the organic light emitting diode OLED of the pixel driving circuit (active pixel) that is connected to the dummy driving circuit (dummy pixel) by the repair wirings.

Since the repair wirings are formed to overlap the pixel electrode of the individual pixel, very high anode parasitic capacitance may be formed in the repair wirings.

As the anode parasitic capacitance is formed, the pixel electrode and the repair wirings may be coupled to each other at a specific voltage, and a boost voltage may be formed at the anode of the organic light emitting diode OLED of the pixel driving circuit (active pixel). The boost voltage may increase the level of the voltage that is applied to the node A of the pixel driving circuit (active pixel), and even if a black signal is applied through this, the voltage of the anode of the organic light emitting diode OLED of the pixel driving circuit (active pixel) becomes higher than the cathode voltage by the boost voltage to cause somewhat light to be emitted.

Further, an initialization line (not illustrated) may be formed in parallel to the repair wirings, and fringe capacitance may be generated due to the initialization line (not illustrated) and the repair wirings. The fringe capacitance may exert an influence on the individual pixel driving circuit (active pixel) according to the voltage that is applied to the gate electrode. That is, the parasitic capacitance may be formed by the initialization line (not illustrated) and the repair wirings.

In comparison to the dummy driving circuit (dummy pixel) illustrated in FIG. 5, the dummy driving circuit (dummy pixel) disclosed in FIG. 6 may further include a first pumping transistor Tp1 connected to the node A' of the dummy driving circuit (dummy pixel), a second pumping transistor Tp2, and a pumping capacitor Cp.

The control electrode of the first pumping transistor Tp1 may receive the scan signal GW[n], and the output electrode thereof may be connected to the node A' of the dummy driving circuit (dummy pixel). The input electrode of the first pumping transistor Tp1 may be connected to the output electrode of the second pumping transistor Tp2 at a pumping node Pnode (a third dummy node).

The control electrode of the second pumping transistor Tp2 may receive the initialization signal GI[n], the output electrode thereof may be connected to the input electrode of the first pumping transistor Tp1 at the pumping node Pnode, and the input electrode thereof may receive the initialization voltage VINIT applied thereto.

The pumping capacitor Cp may connect the pumping node Pnode and the terminal to which the first power voltage ELVDD is applied to each other.

The first pumping transistor Tp1 may connect the node A' of the dummy driving circuit (dummy pixel) and the pumping capacitor Cp to each other in response to the scan signal GW[n] to reduce the amount of charge that is charged by the parasitic capacitance that may be generated in the repair wirings. That is, the parasitic capacitor that may be generated in the repair wirings and the pumping capacitor Cp may be connected in parallel and they may share the electric charge that may be generated in the repair wirings which may be charged only in the parasitic capacitor.

Accordingly, when the data signal having low grayscale is applied by the first and second pumping transistors Tp1 and Tp2 and the pumping capacitor Cp, the organic light emitting diode OLED can be prevented from emitting light somewhat brightly through addition of the pumping capacitor Cp, the organic light emitting diode OLED can be prevented from emitting light somewhat darkly when the data signal having high grayscale is applied.

The second pumping transistor Tp2 may apply the initialization voltage VINIT to the pumping node Pnode in response to the initialization signal GI[n].

One terminal of the pumping capacitor Cp may be connected to the pumping node Pnode, and the other terminal thereof may be connected to the terminal to which the first power voltage ELVDD is applied. However, the other terminal of the pumping capacitor Cp may not be limited to being connected to the terminal to which the first power voltage ELVDD is applied, but may be connected to a terminal to which a constant voltage can be applied. Further, the second pumping transistor Tp2 is not limited to being formed, but may be omitted if needed.

Figure 7:
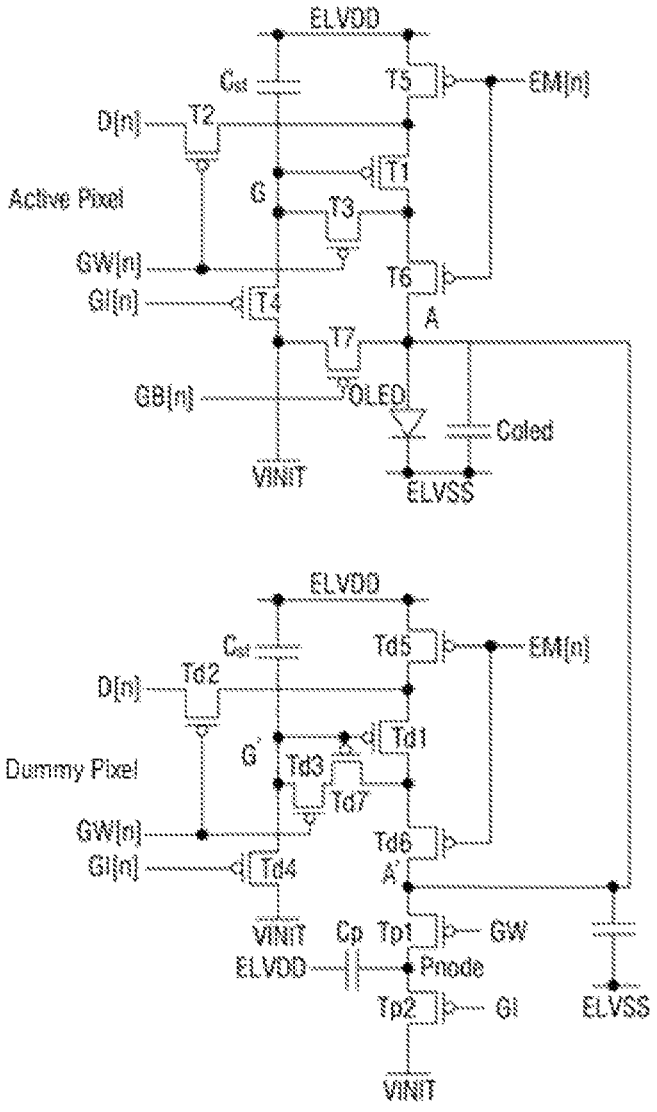
FIG. 7 is an equivalent circuit diagram of one active pixel driving circuit and one dummy pixel driving circuit in a display device according to still another embodiment of the present invention.

FIG. 7 is an equivalent circuit diagram of one pixel driving circuit and one dummy driving circuit in a display device according to still another embodiment of the present invention.

Since FIG. 7 illustrates a circuit having a similar structure to the structure of the circuit illustrated in FIG. 6, explanation of the duplicate constituent elements will be omitted.

Referring to FIG. 7, the control terminals of the fourth pixel transistor T4 and the seventh pixel transistor T7 of the pixel driving circuit may be electrically separated from each other, and the fourth pixel transistor T4 and the seventh pixel transistor T7 may be turned on with different timings by the initialization signal GI[n] and the black voltage signal GB[n], respectively.

Figure 8:
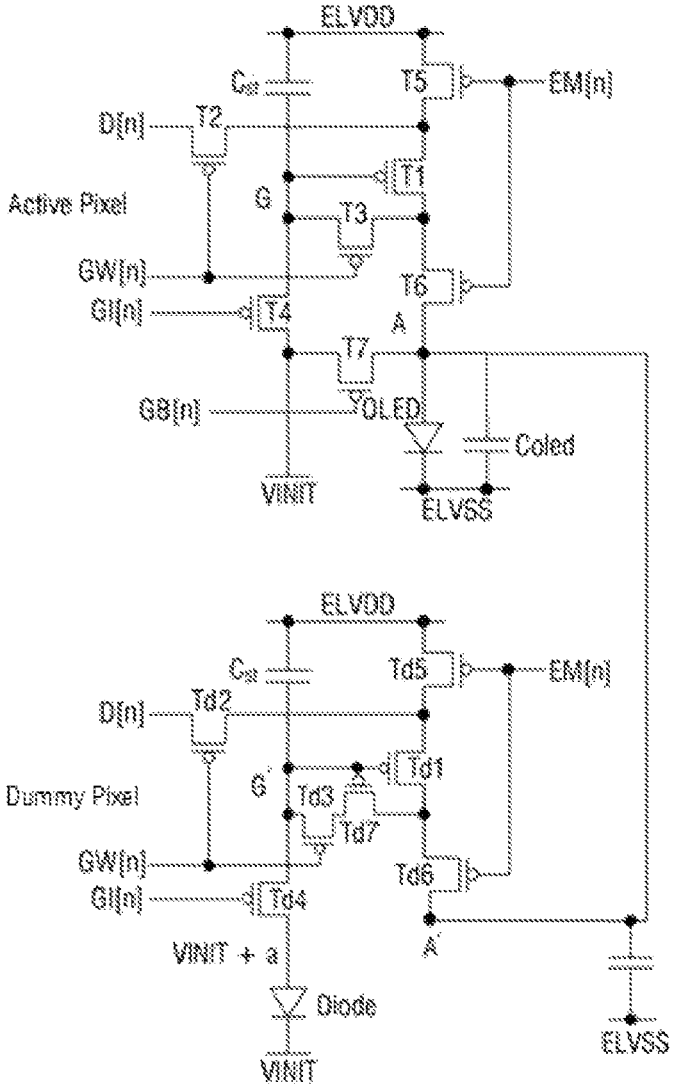
FIG. 8 is an equivalent circuit diagram of one active pixel driving circuit and one dummy pixel driving circuit in a display device according to still another embodiment of the present invention.

FIG. 8 is an equivalent circuit diagram of one pixel driving circuit and one dummy driving circuit in a display device according to still another embodiment of the present invention.

Referring to FIG. 8, the control terminals of the fourth pixel transistor T4 and the seventh pixel transistor T7 of the pixel driving circuit (active pixel) may be electrically separated from each other, and the fourth pixel transistor T4 and the seventh pixel transistor T7 may be driven by the initialization signal GI[n] and the black voltage signal GB[n], respectively.

The pixel driving circuit (active pixel) and the dummy driving circuit (dummy pixel) may be connected to each other by the repair wirings. When inferiority occurs in the pixel driving circuit (active pixel), data may be applied to the organic light emitting diode OLED of the pixel driving circuit (active pixel) that is connected to the dummy driving circuit (dummy pixel) by the repair wirings.

The dummy driving circuit (dummy pixel) and the individual pixel driving circuit (active pixel) may be connected to each other by the repair wirings, and the repair wirings may be formed to overlap the individual pixel driving circuit (active pixel) and to extend in a row direction. Since the repair wirings are formed to overlap the pixel electrode of the individual pixel, very high anode parasitic capacitance may be formed in the repair wirings.

According to this embodiment, in comparison to the dummy driving circuit (dummy pixel) illustrated in FIG. 5, the dummy driving circuit (dummy pixel) disclosed in FIG. 8 may further include a boost diode Diode that is connected to the fourth dummy transistor Td4 (C dummy transistor) of the dummy driving circuit (dummy pixel).

The anode terminal of the boost diode Diode may be connected to the input terminal of the fourth dummy transistor TD4, and the cathode terminal thereof may be connected to the terminal to which the initialization voltage VINIT is applied. Through this, the level of the voltage Vgs between the control electrode and the output electrode of the first dummy transistor Td1 can be reduced. Further, as the level of the voltage Vgs between the control electrode and the output electrode of the first dummy transistor Td1 is reduced, the current that flows to the node A' of the dummy driving circuit (dummy pixel) can be reduced, and thus the amount of electric charge that is charged in the parasitic capacitor that may be generated in the repair wirings can also be reduced. As the amount of the electric charge that is charged in the parasitic capacitor that may be generated in the repair wirings is reduced, the boost voltage VBST is also reduced, and even if the black data and data having low grayscale are applied, the phenomenon that the organic light emitting diode OLED emits light somewhat brightly can be reduced.

The operations of the pixel driving circuit (active pixel) and the dummy driving circuit (dummy pixel) will be described in detail with reference to FIG. 9.

Figure 9:
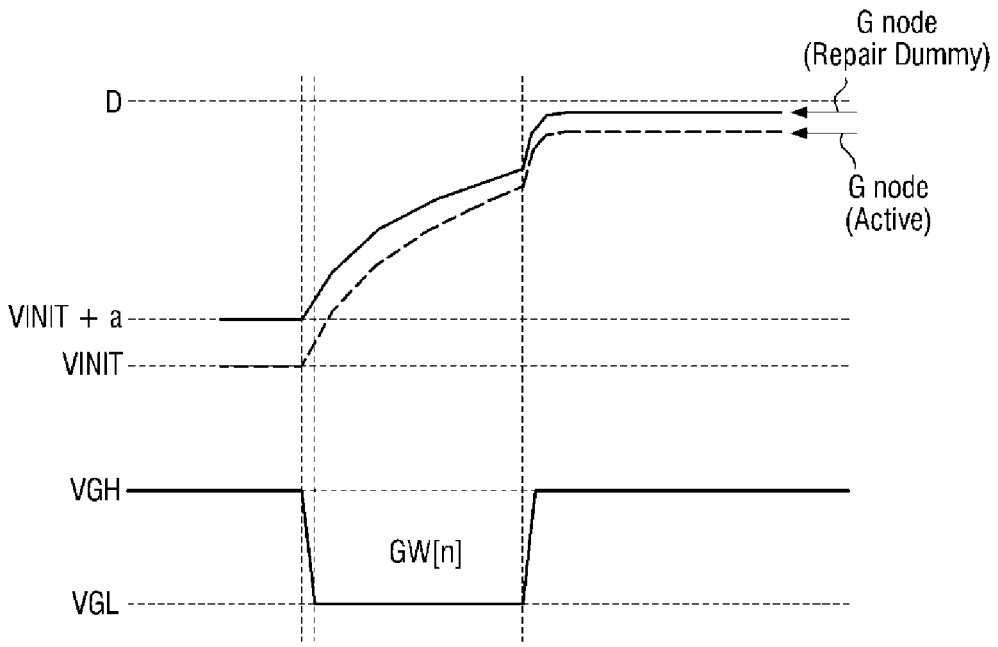
FIG. 9 is a timing diagram illustrating a level change of a signal that is applied to a display device according to still another embodiment of the present invention.

FIG. 9 is a timing diagram illustrating a level change of a signal that is applied to a display device according to still another embodiment of the present invention.

Referring to FIG. 9, if the low-level scan signal GW[n] is applied, the voltage of a node G' of the dummy driving circuit (dummy pixel) is increased on the basis of the initialization voltage VINIT+a that is increased by the boost diode Diode (FIG. 8). During a time in which the low-level scan signal GW[n] is applied, the node G' of the dummy driving circuit (dummy pixel) and the node G of the pixel driving circuit (active pixel) start to be increased at different voltage levels, and thus the voltage of the node G' of the dummy driving circuit (dummy pixel) may be maintained higher than the voltage of the node G of the pixel driving circuit (active pixel).

Since the voltage of the node G' of the dummy driving circuit (dummy pixel) is maintained higher than the voltage of the node G of the pixel driving circuit (active pixel), the voltage Vgs between the control electrode and the output electrode of the first dummy transistor Td1 of the dummy driving circuit (dummy pixel) is lowered, and the driving current that flows to the first dummy transistor Td1 is lowered. Accordingly, even if the black data and the low-grayscale data signal are applied, the phenomenon that the organic light emitting diode OLED emits light somewhat brightly can be reduced.

However, when the high-level scan signal GW[n] is applied, the voltage is somewhat increased by the self capacitance of the third dummy transistor Td3, but it may be assumed that constant voltage can be maintained to some extent although it is mainly changed according to the threshold voltage of the third dummy transistor Td3 and a design layout of the circuit.

FIGS. 10 through 13 are equivalent circuit diagrams of one pixel driving circuit and one dummy driving circuit in a display device according to still another embodiment of the present invention.

Since FIGS. 10 through 13 illustrate circuits having similar structure to the structure of the circuit of FIG. 8, explanation of the duplicate constituent elements will be omitted.

Figure 10:
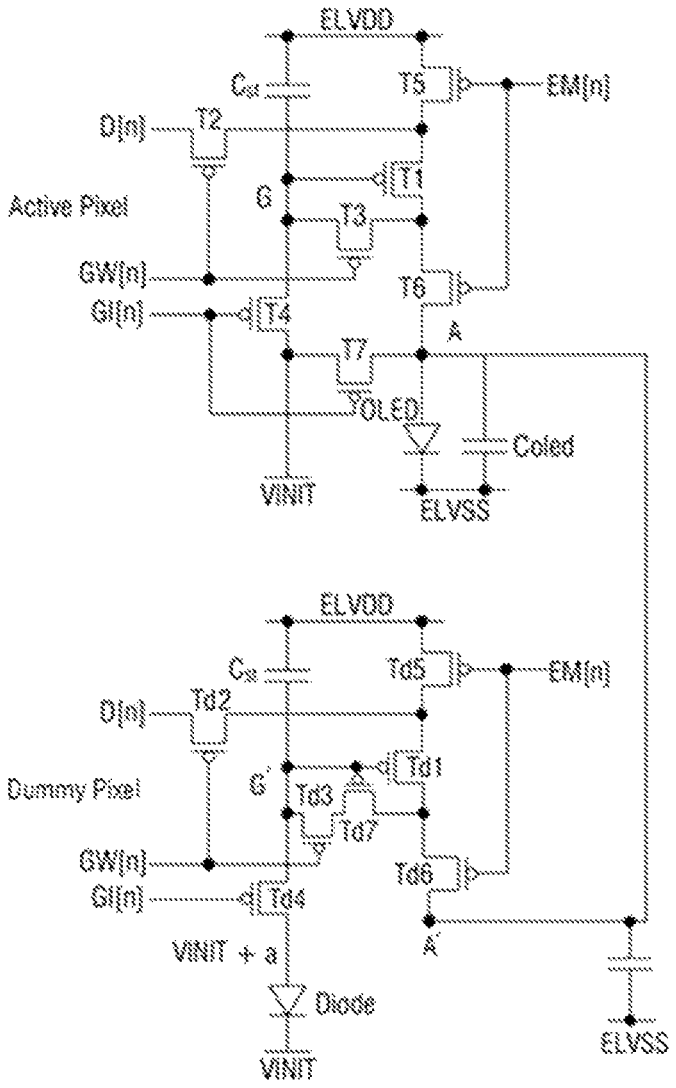
FIGS. 10 through 13 are equivalent circuit diagrams of one active pixel driving circuit and one dummy pixel driving circuit in a display device according to still another embodiment of the present invention.

Referring to FIG. 10, the control electrodes of the fourth pixel transistor T4 and the seventh pixel transistor T7 of the pixel driving circuit (active pixel) may be electrically connected to each other, and the fourth pixel transistor T4 and the seventh pixel transistor T7 may be driven by the signal GI[n].

Since the control electrodes of the fourth pixel transistor T4 and the seventh pixel transistor T7 of the pixel driving circuit (active pixel) are electrically connected to each other, the voltage level of the repair wirings may be increased at a rising edge of the initialization signal GI[n].

Figure 11:
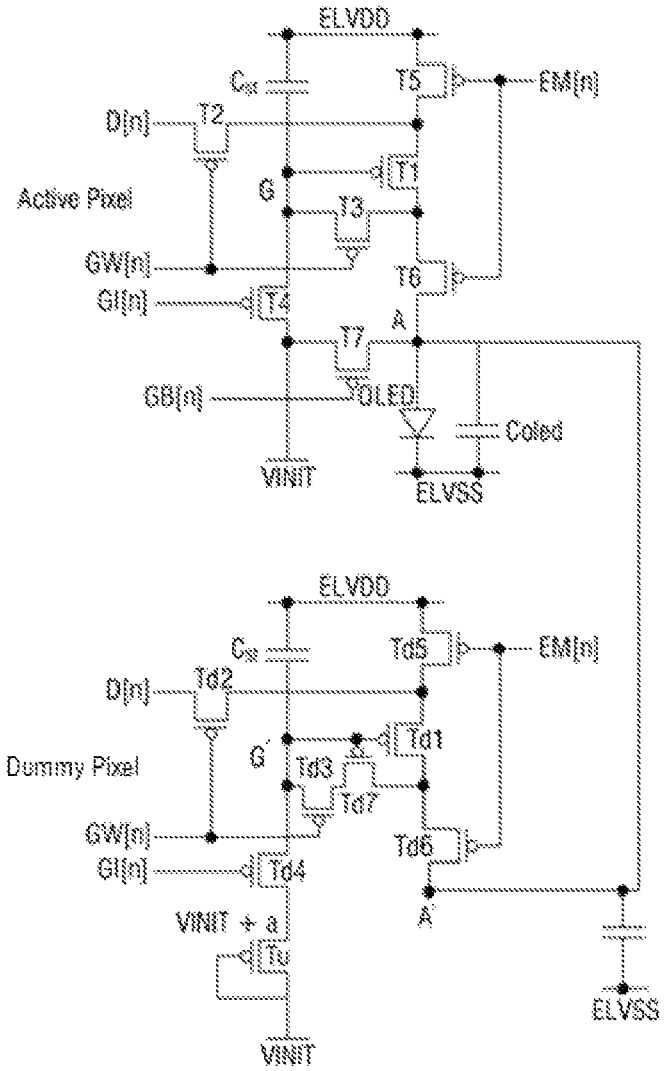

Referring to FIG. 11, a boost transistor Tu may be included instead of the boost diode Diode of FIG. 8. The control electrode of the boost transistor Tu may be connected to the input electrode of the boost transistor Tu to form a diode connection. Due to the diode connection, the boost transistor Tu may serve as a diode, and may apply the initialization voltage VINIT+a, which is increased by the threshold voltage Vth of the boost transistor Tu, to the fourth dummy transistor Td4.

Through this, the level of the voltage Vgs of the first dummy transistor Td1 can be reduced. Further, as the level of the voltage Vgs between the control electrode and the output electrode of the first dummy transistor Td1 is lowered, the current that flows to the node A' of the dummy driving circuit (dummy pixel) can be reduced, and thus the amount of electric charge that is charged in the parasitic capacitor that may be generated in the repair wirings can also be reduced. As the amount of the electric charge that is charged in the parasitic capacitor that may be generated in the repair wirings is reduced, the boost voltage level is also reduced, and even if the black data and low-grayscale data are applied, the phenomenon that the organic light emitting diode OLED emits light somewhat brightly can be reduced.

FIG. 11 illustrates a structure in which the control electrodes of the fourth pixel transistor T4 and the seventh pixel transistor T7 of the pixel driving circuit (active pixel) are electrically separated from each other, but are not limited thereto. The structure may be modified to a structure in which the control electrodes of the fourth pixel transistor T4 and the seventh pixel transistor T7 of the pixel driving circuit (active pixel) are connected to each other.

Figure 12:
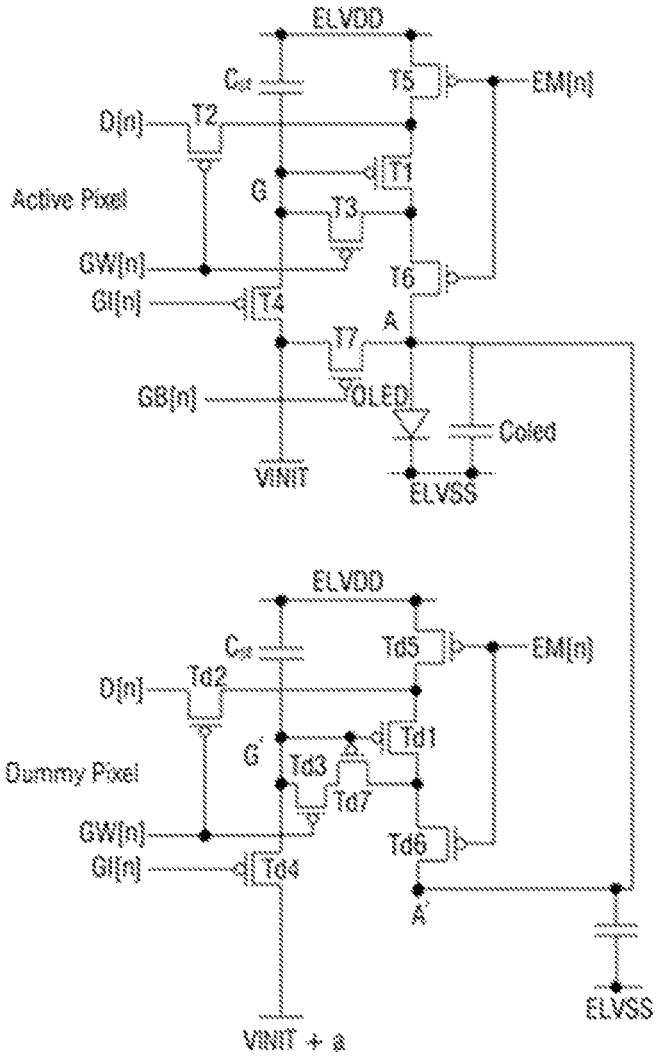

Referring to FIG. 12, the boosted voltage may be directly applied to the fourth dummy transistor instead of the boost diode Diode of FIG. 8. By applying the increased initialization voltage VINIT+a to the fourth dummy transistor T4, the level of the voltage Vgs between the control electrode and the output electrode of the first dummy transistor Td1 can be reduced. Further, as the level of the voltage Vgs between the control electrode and the output electrode of the first dummy transistor Td1 is reduced, the current that flows to the node A' of the dummy driving circuit (dummy pixel) can be reduced, and thus the amount of electric charge that is charged in the parasitic capacitor that may be generated in the repair wirings can also be reduced. As the amount of the electric charge that is charged in the parasitic capacitor that may be generated in the repair wirings is reduced, the boost voltage can be reduced, and thus even if the black data and the low-grayscale data are applied, the phenomenon that the organic light emitting diode OLED emits light somewhat brightly.

Figure 13:
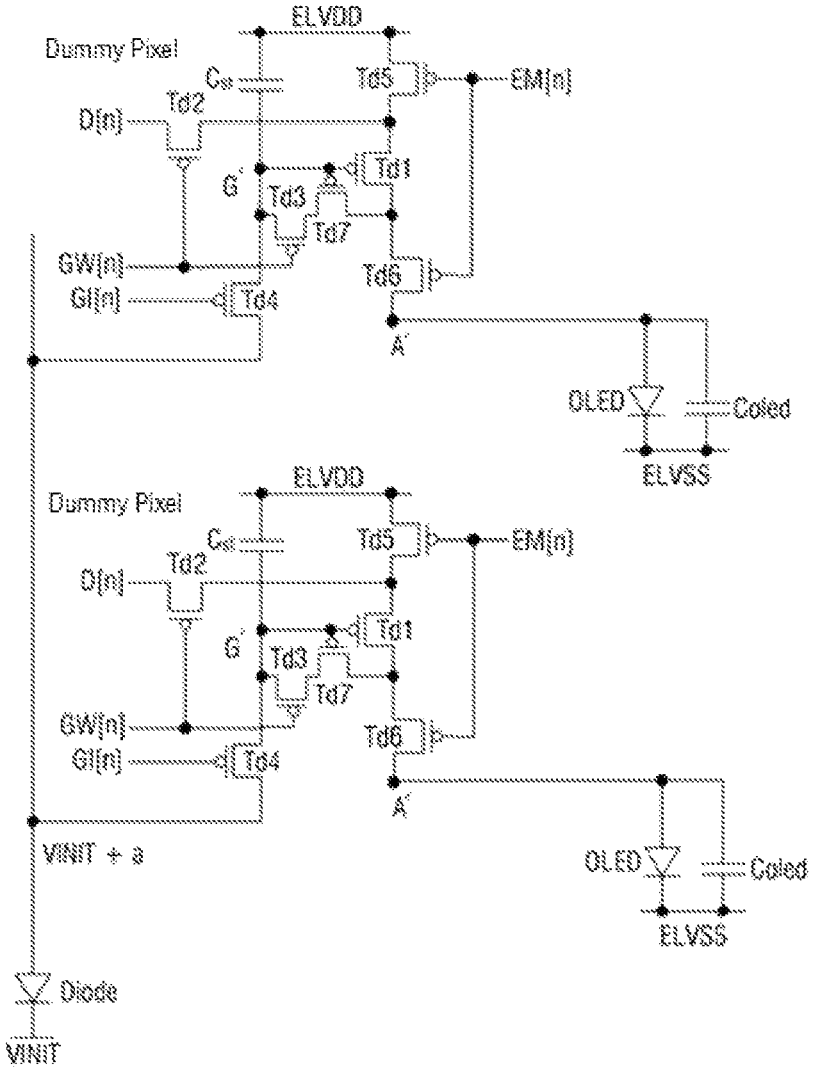

Referring to FIG. 13, the boost diode Diode is not formed for each line of the individual pixel driving circuit (active pixel), but may be formed on lines of a plurality of pixel driving circuits (active pixels). The boost diode Diode is a constituent element that is added to apply the boosted voltage that is higher than the initialization voltage VINIT to the fourth dummy transistors Td4, and even if the fourth dummy transistors Td4 of the plurality of pixel driving circuits (active pixels) are connected to the anode terminal of the boost diode Diode, the driving current of the first dummy transistor Td1 of each pixel driving circuit (active pixel) can be reduced.

FIG. 13 illustrates the boost diode Diode that is connected to the plurality of pixel driving circuits (active pixels), but is not limited thereto. A structure, which connects the source terminal of the boost transistor Tu to the drain electrodes of the plurality of fourth dummy transistors Td4 or which applies the boosted voltage to the drain electrodes of the plurality of fourth dummy transistors Td4, may be included.

Figure 14:
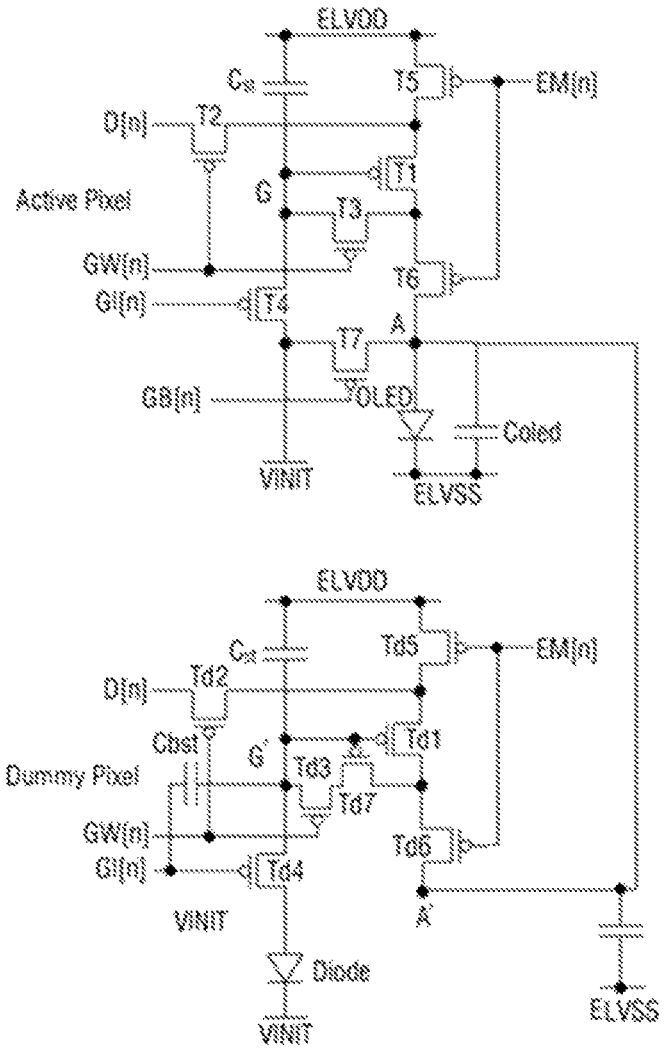
FIG. 14 is an equivalent circuit diagram of one active pixel driving circuit and one dummy pixel driving circuit in a display device according to still another embodiment of the present invention.
Figure 15:
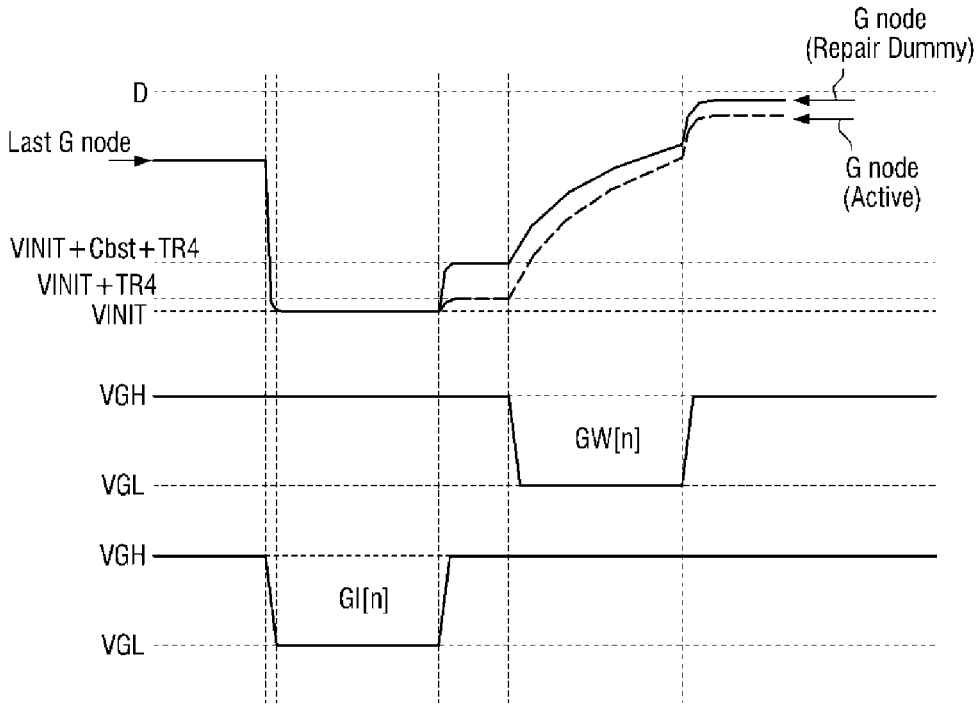
FIG. 15 is a timing diagram illustrating a level change of a signal that is applied to a display device according to still another embodiment of the present invention.

FIG. 14 is an equivalent circuit diagram of one pixel driving circuit and one dummy driving circuit in a display device according to still another embodiment of the present invention, and FIG. 15 is a timing diagram illustrating a level change of a signal that is applied to a display device according to still another embodiment of the present invention.

Since FIG. 14 illustrates a circuit having a similar structure to the structure of the circuit illustrated in FIG. 10, explanation of the duplicate constituent elements will be omitted.

Referring to FIG. 14, the control electrodes of the fourth pixel transistor T4 and the seventh pixel transistor T7 of the pixel driving circuit (active pixel) may be electrically separated from each other, and the fourth pixel transistor T4 and the seventh pixel transistor T7 may be driven by the initialization signal GI[n] and the black voltage signal GB[n], respectively.

In comparison to the dummy driving circuit (dummy pixel) illustrated in FIG. 10, the dummy driving circuit (dummy pixel) may further include a boost capacitor Cbst that connects the terminal to which the initialization signal GI[n] is applied to the dummy driving circuit (dummy pixel).

The boost capacitor Cbst is connected to the node G' of the dummy driving circuit (dummy pixel), and when the high-level initialization signal GI[n] is applied, it boosts the voltage of the node G'. Through this, the level of the voltage Vgs between the control electrode and the output electrode of the first dummy transistor Td1 can be reduced. Further, as the level of the voltage Vgs between the control electrode and the output electrode of the first dummy transistor Td1 is reduced, the current that flows to the anode of the dummy driving circuit (dummy pixel) can be reduced, and thus the amount of electric charge that is charged in the parasitic capacitor that may be generated in the repair wirings can also be reduced. As the amount of the electric charge that is charged in the anode parasitic capacitor is reduced, the boost voltage is also reduced, and even if the black data and the data having low grayscale are applied, the phenomenon that the organic light emitting diode OLED emits light somewhat brightly can be reduced.

FIG. 14 illustrates the structure in which the control electrodes of the fourth pixel transistor T4 and the seventh pixel transistor T7 of the pixel driving circuit (active pixel) are electrically separated from each other, but is not limited thereto. A structure, in which the control electrodes of the fourth pixel transistor T4 and the seventh pixel transistor T7 are electrically connected, may be included.

The operations of the pixel driving circuit (active pixel) and the dummy driving circuit (dummy pixel) will be described in detail with reference to FIG. 15.

Referring to FIG. 15, the initialization signal GI[n] is increased from low level to high level, and a voltage that is higher than the voltage that is increased by the initialization voltage VINIT and the parasitic capacitance of the fourth dummy transistor Td4 is charged in the boost capacitor Cbst that is connected to the terminal to which the initialization signal GI[n] is applied.

If the voltage of the node G' is increased by the initialization signal GI[n] and the low-level scan signal GW[n] is applied, the voltage of the node G' of the dummy driving circuit (dummy pixel) is increased on the basis of the initialization voltage that is increased by the boost capacitor Cbst and the parasitic capacitance of the transistor Td4. During a time in which the low-level scan signal GW[n] is applied, the dummy driving circuit (dummy pixel) and the pixel driving circuit (active pixel) start to be increased at different voltage levels, and thus the voltage of the node G' of the dummy driving circuit (dummy pixel) may be maintained higher than the voltage of the node G of the pixel driving circuit (active pixel).

Since the voltage of the node G' of the dummy driving circuit (dummy pixel) is maintained to be higher than the voltage of the G node G of the pixel driving circuit (active pixel), the voltage Vgs between the control electrode and the output electrode of the first dummy transistor Td1 of the dummy driving circuit (dummy pixel) is lowered, and the driving current that flows to the first dummy transistor Td1 is lowered. Accordingly, even if the black data and the low-grayscale data signal are applied, the phenomenon that the organic light emitting diode OLED emits light somewhat brightly can be reduced.

However, when the high-level scan signal GW[n] is applied, the voltage is somewhat increased by the self capacitance of the third dummy transistor Td3, but it may be assumed that constant voltage can be maintained to some extent although it is mainly changed according to the threshold voltage of the third dummy transistor Td3 and the design layout of the circuit.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device, comprising:

a display panel including a plurality of active pixels and a plurality of dummy pixels adjacent to the plurality of active pixels; and a control unit controlling a pixel driving circuit formed in each of the active pixels and a dummy driving circuit formed in each of the dummy pixels, wherein the dummy driving circuit comprises:

a dummy driving transistor having a control terminal connected to one terminal of a storage capacitor and an input terminal receiving a data signal;

an A dummy transistor; and a B dummy transistor having a control terminal receiving a scan signal which is different from the data signal, wherein a control terminal of the A dummy transistor is connected to the control terminal of the dummy driving transistor, an input terminal of the A dummy transistor is connected to an output terminal of the B dummy transistor, and an output terminal of the A dummy transistor is connected to an output terminal of the dummy driving transistor.

2. The display device of claim 1, further comprising:

repair wirings formed to extend in a first direction, wherein the repair wirings are formed to overlap the plurality of active pixels that are aligned in the first direction.

3. The display device of claim 2, wherein the dummy driving circuit further comprises:

a first dummy node outputting a driving current that is generated by the dummy driving transistor; and a second dummy node connecting a control terminal of the dummy driving transistor to an input terminal of the B dummy transistor, and wherein the pixel driving circuit comprises:

an organic light emitting diode: and a first pixel node connected to an anode terminal of the organic light emitting diode.

4. The display device of claim 3, wherein the dummy driving circuits of the dummy pixels that are formed on both ends of the display panel in the first direction are electrically connected to each other through the repair wirings at the first dummy node.

5. The display device of claim 4, wherein the dummy driving circuit further comprises:

a dummy switching transistor, wherein a control electrode of the dummy switching transistor is connected to a control terminal of the B dummy transistor and a terminal to which a scan signal is applied, and an input electrode of the dummy switching transistor is connected to a terminal to which a data voltage is applied.

6. The display device of claim 3, wherein the pixel driving circuit is able to be electrically connected to the repair wirings at the first pixel node.

7. The display device of claim 2, wherein the control unit comprises:

a comparison unit determining whether the pixel driving circuit has inferiority; and a synchronization unit synchronizing an output signal of the dummy driving circuit with a data signal provided to the pixel driving circuit.

8. The display device of claim 7, wherein the comparison unit controls a connection between the repair wirings and a first pixel node of the pixel driving circuit that is formed in each of the active pixels.

9. The organic light emitting display of claim 7, further comprising a control unit configured to turn on the third transistor in a first period to apply the first driving voltage to the first node, to turn on the second transistor on in a second period that is subsequent to the first period to apply the sustain voltage to the first node, to turn on the switching transistor in a third period that is subsequent to the second period to apply a voltage that corresponds to the data signal to the first node, wherein the first driving voltage is applied to the first node in a fourth period that is subsequent to the third period.

10. The display device of claim 9, further comprising:

repair wirings formed to extend in a first direction, wherein the repair wirings are formed to overlap the plurality of active pixels that are aligned in the first direction.

11. The display device of claim 10, wherein the dummy driving circuit includes a first dummy node outputting a driving current that is generated by the dummy driving transistor, the pixel driving circuit includes an organic light emitting diode and a first pixel node connected to an anode terminal of the organic light emitting diode, the dummy driving circuits of the dummy pixels that are formed on both ends of the display panel in the first direction are electrically connected to each other through the repair wirings at the first dummy node of the dummy driving circuit, and the pixel driving circuit is electrically connectable to the repair wirings at the first pixel node.

12. The display device of claim 10, wherein the control unit comprises:

a comparison unit determining whether each of the pixel driving circuits has inferiority; and a synchronization unit synchronizing an output signal of the dummy driving circuit with a data signal provided to the pixel driving circuit.

13. The display device of claim 12, wherein the comparison unit controls a connection between the repair wirings and a first pixel node of the pixel driving circuit that is formed in each of the active pixels.

14. The display device of claim 9, further comprising:

an initialization line extending in a second direction, wherein an input terminal of the C dummy transistor of the dummy driving circuit adjacent in the second direction is electrically connectable to the initialization line.

15. The display device of claim 1, wherein the dummy driving circuits further comprises:

a first pumping transistor and a second pumping transistor connecting a terminal to which an initialization voltage is applied and a first dummy node'; and a pumping capacitor connected to a third dummy node at which an input terminal of the first pumping transistor and an output terminal of the second pumping transistor are connected to each other and a first power voltage terminal, wherein a control terminal of the first pumping transistor is connected to a terminal to which a first input signal is applied, an output terminal of the first pumping transistor is connected to the first dummy node', an input terminal of the first pumping transistor is connected to an output terminal of the second pumping transistor at the third dummy node, a control terminal of the second pumping transistor is connected to a terminal to which a second input signal is applied, and an input terminal of the second pumping transistor is connected to a terminal to which an initialization voltage is applied.

16. The display device of claim 15, further comprising:

repair wirings formed to extend in a first direction, wherein the repair wirings are formed to overlap the plurality of active pixels aligned in the first direction.

17. The display device of claim 16, wherein the dummy driving circuit includes a first dummy node outputting a driving current that is generated by the dummy driving transistor, the pixel driving circuit includes an organic light emitting diode and a first pixel node connected to an anode terminal of the organic light emitting diode, the dummy driving circuits of the dummy pixels that are formed on both ends of the display panel in the first direction are electrically connected to each other through the repair wirings at the first dummy node of the dummy driving circuit, and the pixel driving circuit is electrically connectable to the repair wirings at the first pixel node.

18. A display device, comprising:

a display panel including a plurality of active pixels and a plurality of dummy pixels adjacent to the plurality of active pixels; and a control unit controlling a pixel driving circuit formed in each of the active pixels and a dummy driving circuit formed in each of the dummy pixels, wherein the dummy driving circuit comprises:

a dummy driving transistor having a control terminal connected to one terminal of a storage capacitor;

an A dummy transistor;

a B dummy transistor having a control terminal receiving a scan signal;

a C dummy transistor having a control terminal receiving a previous scan signal; and a boost transistor, wherein a control terminal of the A dummy transistor is connected to the control terminal of the dummy driving transistor, an input terminal of the A dummy transistor is connected to an output terminal of the B dummy transistor, and an output terminal of the A dummy transistor is connected to an output terminal of the dummy driving transistor, an output terminal of the C dummy transistor is connected to the control terminal of the dummy driving transistor, and an input terminal of the C dummy transistor is connected to an output terminal of the boost transistor, and an input terminal of the boost transistor is connected to a terminal to which an initialization voltage is applied, and a control terminal of the boost transistor is connected to the input terminal of the boost transistor to form a diode connection.

19. The display device of claim 18, wherein the control unit comprises:

a comparison unit determining whether the pixel driving circuit has inferiority; and a synchronization unit synchronizing an output signal of the dummy driving circuit with a data signal provided to the pixel driving circuit.

20. The display device of claim 18, further comprising:

repair wirings formed to extend in a first direction, wherein the repair wirings are formed to overlap the plurality of active pixels that are aligned in the first direction.

* * * * *